United States Patent [19]

Paton et al.

[11] Patent Number: 4,973,805

[45] Date of Patent: Nov. 27, 1990

[54] ARC RUNNER, CONTAINMENT SUPPORT ASSEMBLY

[75] Inventors: Charles R. Paton, New Brighton; Kurt A. Grunert, Beaver; Glenn C. Sisson, Coraopolis, all of Pa.

[73] Assignee: Westinghouse Electric Corp., Pittsburgh, Pa.

[21] Appl. No.: 331,769

[22] Filed: Apr. 3, 1989

[51] Int. Cl.[5] ..... H01H 33/18; H01H 33/20

[52] U.S. Cl. ..... 200/147 R; 200/144 R

[58] Field of Search ..... 200/147 R, 144 R

[56] References Cited

U.S. PATENT DOCUMENTS

| | | | |
|---|---|---|---|
| 4,642,430 | 2/1987 | Tedesco | 200/153 G |
| 4,642,431 | 2/1987 | Tedesco | 200/153 G |
| 4,649,242 | 3/1987 | Kralik | 200/147 R |
| 4,654,491 | 3/1987 | Maier et al. | 200/147 R |
| 4,697,163 | 9/1987 | Grunert | 335/174 |
| 4,761,626 | 8/1988 | Teraoka | 200/147 R |

*Primary Examiner*—Robert S. Macon

*Attorney, Agent, or Firm*—M. J. Moran

[57] ABSTRACT

Briefly, the present invention relates to a molded case circuit breaker. The molded case circuit breaker includes at least one pair of separable main contacts, mounted on upper and lower contact arms. One end of the lower contact arm is formed as a U-shaped portion defining depending leg portions and a bight portion forming a reverse current loop. Disposed adjacent the lower main contact on the lower contact arm is an arc runner assembly which directs the arc resulting from a separation from the upper and lower main contacts into an arc chute to quench the arc. The arc runner assembly includes an arc runner and a support block. The arc runner may be formed from steel and is carried by the support block, disposed between depending leg portions of the lower contact arm. The support block is formed from an electrically insulating material, such as a glass polyester. The support block fixes the arc runner adjacent the main contact on the lower contact arm and also prevents bending of the lower contact arm due to repeated operations of the circuit breaker which can affect the normal contact pressure between the main contacts. The arc runner is provided with a downwardly extending retaining boss received in an aperture in the support block to provide mechanical retention of the arc runner with respect to the support block. The support block is mechanically positioned relative to the lower contact arm.

9 Claims, 3 Drawing Sheets

ARC RUNNER, CONTAINMENT SUPPORT ASSEMBLY

CROSS-REFERENCE TO RELATED APPLICATIONS

The invention disclosed herein relates to molded case circuit breakers.

The following seven patent applications all relate to molded case circuit breakers and were filed on Aug. 1, 1988: Ser. No. 226,500, entitled RUBBER STOPS IN OUTSIDE POLES, William E. Beatty, Jr., Lawrence J. Kapples, Lance Gula and Joseph F. Changle, Westinghouse Case No. WE-54,532; Ser. No. 226,648, entitled CT QUICK CHANGE ASSEMBLY, by Jere L. McKee, William E. Beatty, Jr. and Glenn R. Thomas, Westinghouse Case No. WE-54,533; Ser. No. 226,503, entitled CROSS-BAR ASSEMBLY, by Jere L. McKee, Lance Gula, and Glenn R. Thomas, Westinghouse Case No. WE-54,579; Ser. No. 226,649, entitled LAMINATED COPPER ASSEMBLY, by Charles R. Paton, Westinghouse Case No. WE-54,580; Ser. No. 226,650, entitled CAM ROLL PIN ASSEMBLY, by Lance Gula and Jere L. McKee, Westinghouse Case No. WE-54,594; Ser. No. 226,655, entitled COMBINATION BARRIER AND AUXILIARY CT BOARD by Gregg Nissly, Allen B. Shimp and Lance Gula, Westinghouse Case No. WE-54,821; Ser. No. 226,654, entitled MODULAR OPTION DECK ASSEMBLY by Andrew J. Male, Westinghouse Case No. WE-54,822.

The following four commonly assigned U.S. patent applications were filed on Oct. 12, 1988 and all relate to molded case circuit breakers: Ser. No. 256,881 entitled SCREW ADJUSTABLE CLINCH JOINT WITH BOSSES, by James N. Altenhof, Ronald W. Crookston, Walter V. Bratkowski, and J. Warren Barkell, Westinghouse Case No. WE-54,694; Ser. No. 256,879 entitled TAPERED STATIONARY CONTACT LINE COPPER, by Ronald W. Crookston, Westinghouse Case No. WE-54,695; Ser. No. 256,880, entitled SIDE PLATE TAPERED TWIST-TAB FASTENING DEVICE FOR FASTENING SIDE PLATES TO THE BASE, by K. Livesey and Albert E. Maier, Westinghouse Case No. WE-54,715; Ser. No. 256,878, entitled TWO-PIECE CRADLE LATCH FOR CIRCUIT BREAKER, by Albert E. Meier and William G. Eberts, Westinghouse Case No. WE-54,870.

Lastly, the following commonly assigned U.S. patent application was filed on Oct. 21, 1988, which also relates to a molded case circuit breaker: Ser. No. 260,848, entitled UNRIVETED UPPER LINK SECUREMENT, by Joseph Changle and Lance Gula, Westinghouse Case No. WE-54,713I.

BACKGROUND OF THE INVENTION

1. Field of the Invention

This invention relates to molded case circuit breakers and, more particularly to an arc runner assembly disposed adjacent the separable main contacts which allows the circuit breaker to interrupt a relatively higher overcurrent.

2. Description of the Prior Art

Molded case circuit breakers are generally old and well known in the art. Examples of such circuit breakers are disclosed in U.S. Pat. Nos. 4,642,430 and 4,642,431. Such circuit breakers are used to protect electrical circuitry from damage due to an overcurrent condition, such as an overload and a relatively high level short circuit condition. An overload condition is about two hundred to three hundred percent of the nominal current rating of the circuit breaker. A high level short circuit condition can be 1000% or more of the nominal current rating of the circuit breaker.

Molded case circuit breakers include at least one pair of separable main contacts which may be operated either manually by way of a handle disposed on the outside of the case, or automatically in response to an overcurrent condition. In the automatic mode of operation, the main contacts may be opened by an operating mechanism or by magnetic repulsion forces. The magnetic repulsion forces cause the main contacts to separate under relatively high level short circuit conditions. In many known circuit breakers, such as disclosed in U.S. Pat. Nos. 4,642,430 and 4,642,431, the separable main contacts are carried by pivotally mounted upper and lower contact arms. More specifically, the upper main contact is carried by a pivotally mounted upper contact arm connected to a load side conductor. The lower main contact is carried by a U-shaped contact arm pivotally mounted with respect to the line side conductor of the circuit breaker. The U-shaped configuration of the lower contact arm causes a reversing of the direction of current flow in the lower contact arm with respect to the upper contact arm, thereby creating magnetic repulsion forces during a relatively high level short circuit condition. These magnetic repulsion forces cause the lower contact arm to rotate downwardly and also cause the upper contact arm to be blown open.

The separation of the upper and lower main contacts generates an electrical arc. The electrical arc is quenched by an arc chute assembly, disposed adjacent the main contacts. In such an arrangement, however, some of the energy in the electrical arc is dispersed by the pivotal movement of the lower contact arm assembly. Specifically, the downward movement of the lower contact arm to rotate downwardly, provides for adequate electrical separation between the lower main contact and the upper main contact. However, such a pivotal lower contact arm is a relatively complicated structure and is also relatively expensive, as compared with molded case circuit breakers used to interrupt relatively lower level overcurrents. For example, in the latter mentioned circuit breakers, the lower contact arm is formed as a U-shape member and is rigidly mounted to the circuit breaker base. Such an arrangement provides for a relatively less complicated and less expensive circuit breaker. However, a rigidly mounted lower contact arm assembly has heretofore not been known to be used at overcurrent levels which currently utilize a pivotally mounted lower contact arm assembly.

SUMMARY OF THE INVENTION

It is an object of the present invention to provide a molded case circuit breaker which solves the problems associated with the prior art.

It is a further object of the present invention to provide a molded case circuit breaker, relatively less complicated than known molded case circuit breakers provided with pivotally mounted lower contact arms used for interrupting relatively higher level overcurrent.

It is yet a further object of the present invention to provide an arc runner assembly disposed adjacent a rigidly mounted lower contact arm for directing the arc generated during separation of the main contacts into an arc chute.

Briefly, the present invention relates to a molded case circuit breaker and, more particularly, to a molded case circuit breaker which allows the circuit breaker to interrupt a relatively large overcurrent. The molded case circuit breaker includes at least one pair of separable main contacts. The separable main contacts are mounted on upper and lower contact arms. The upper contact arm carries an upper main contact and is pivotally mounted to a load side conductor. The upper contact arm is also operatively coupled to an operating mechanism. A lower contact arm is rigidly connected to the base of the circuit breaker. One end of the lower contact arm is formed as a U-shaped portion to form a reverse current loop defining upper and lower depending leg portions and a bight portion. The upper depending leg portion carries the lower main contact. Disposed adjacent the lower main contact is an arc runner assembly, which directs the arc resulting from separation from the upper and lower main contacts, into an arc chute for quenching of the arc. The arc runner assembly may be formed from steel and is carried by a support block disposed adjacent the lower contact arm. The support block is molded from an electric insulating material, such as a glass polyester. The support block is disposed between the upper and lower depending leg portions of the lower contact arm. The support block positions the arc runner adjacent the lower main contact and provides a bearing surface for the lower depending leg portion of the lower contact arm. The arc runner provides a bearing surface for the upper depending leg portion. The support block prevents the upper and lower depending leg portions of the lower contact arm from bending toward each other as a result of repeated operations of the circuit breaker. The arc runner is provided with a downwardly extending retaining boss received in the support block which provides mechanical retention of the arc runner. The support block is also mechanically positioned relative to the lower contact arm.

DESCRIPTION OF THE DRAWING

These and other objects and advantages of the present invention will become readily apparent upon consideration of the following detailed description and attached drawing, wherein.

DETAILED DESCRIPTION

Figure 1:
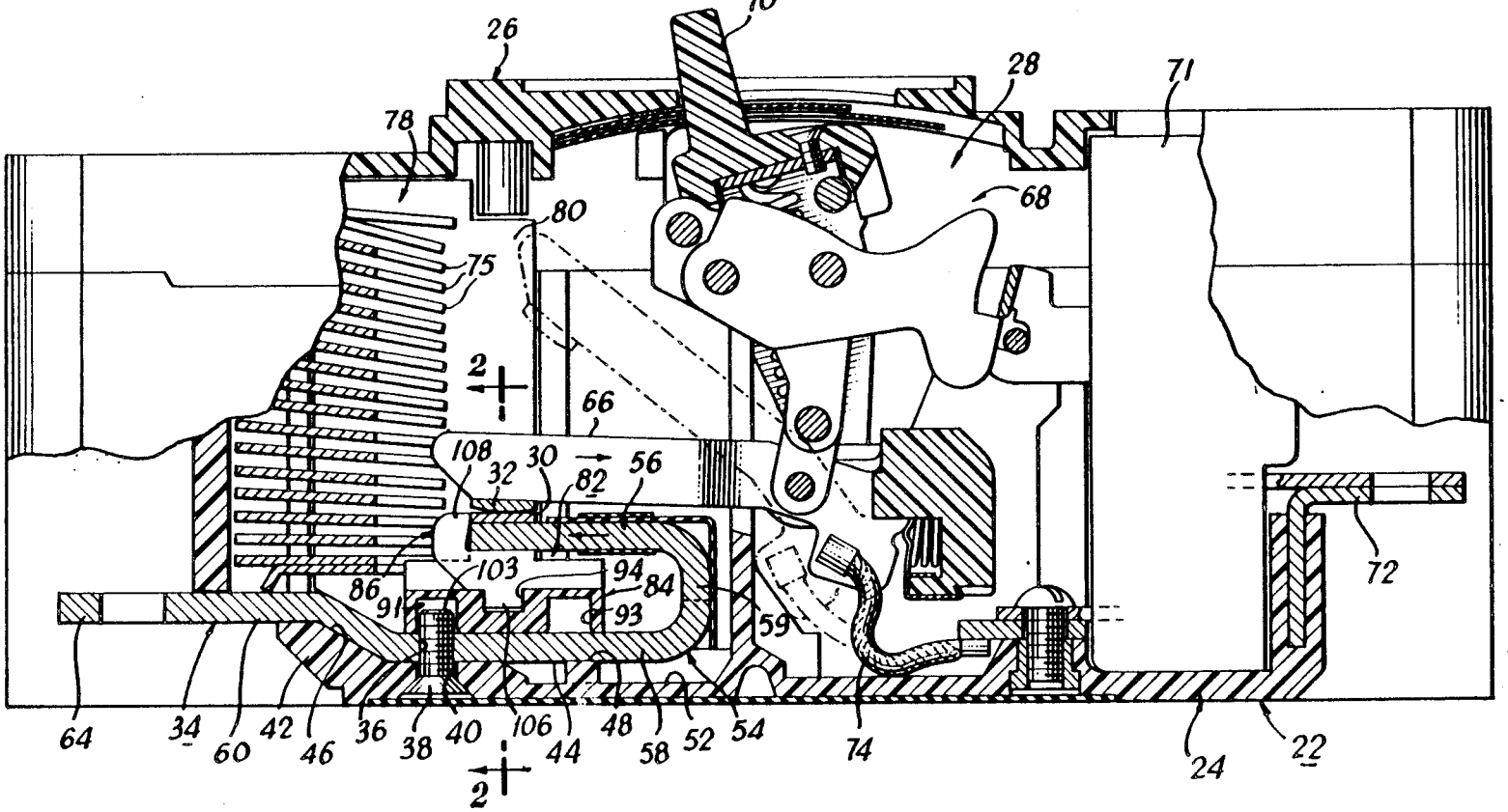
FIG. 1 is a side elevational view, partially broken away, of the molded case circuit breaker in accordance with the present invention.
Figure 2:
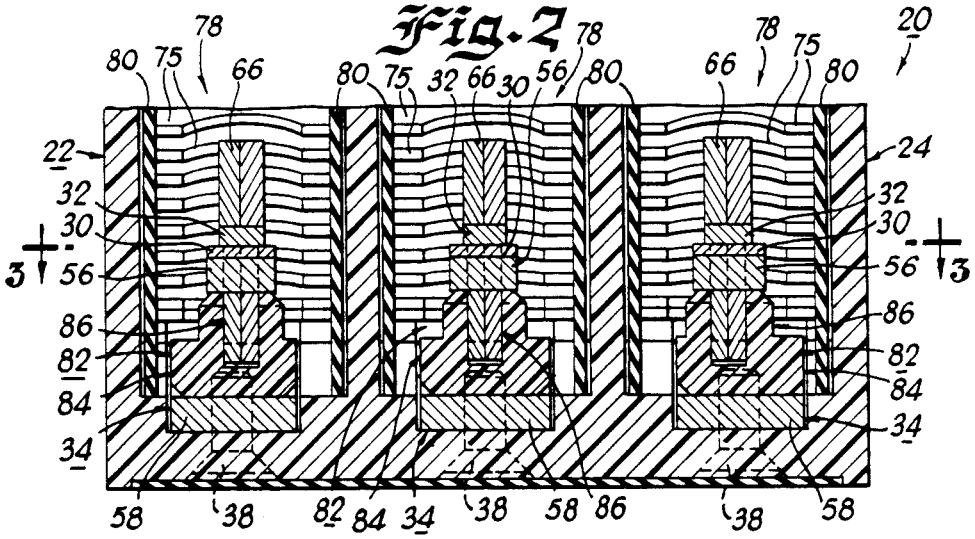
FIG. 2 is a transverse cross-sectional view taken along the line 2—2 of FIG. 1.
Figure 3:
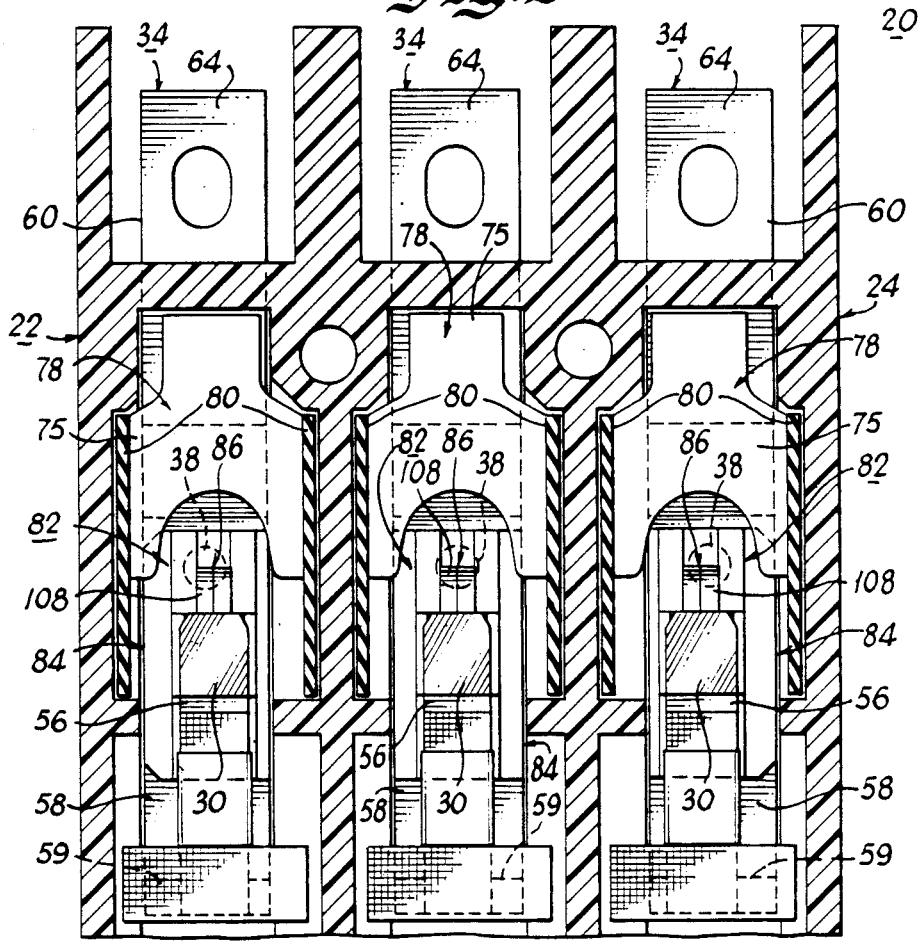
FIG. 3 is a plan sectional view taken along the line 3—3 of FIG. 2.

A molded case circuit breaker, generally indicated by the reference numeral 20, comprises an electrically insulated housing 22 having a molded base 24 and a molded coextensive cover 26. The internal portion of the base 24 is formed as a frame 28 for carrying the various components of the circuit breaker. As illustrated and described herein, a Westinghouse Series C, type HJD molded case circuit breaker will be described. However, the principles of the present invention are applicable to various other types of molded case circuit breakers.

At least one pair of separable lower and upper main contacts 30 and 32 are provided within the housing 22. The lower main contact 30, carried by a lower contact arm 34, is rigidly mounted with respect to the base 24. The lower contact arm 34 is provided with a threaded aperture 36. A fastener 38 is received in the threaded aperture 36 via another aperture 40 disposed in the line side portion 42 of the base 24 to secure the lower contact arm 34 to the base 24. The undersurface 44 of the lower contact arm 34 is carried by bearing surfaces 46 and 48 formed in the base 24.

The bearing surface 46 is formed with a contour similar to that of a portion of the lower contact arm 34. The bearing surface 48 is an upwardly extending protuberance, disposed in a cavity 52, formed in the base 24.

The lower contact arm 34 is formed from an electrical conductor material, such as a flat copper bar. The flat copper bar is formed into a U-shaped portion 54 at one end defining a depending upper leg portion 56, a depending lower leg portion 58 and a bight portion 59. The upper leg portion 56 carries the lower main contact 30. The lower leg portion 58 is disposed adjacent the base 24 such that the threaded aperture 36 is aligned with an aperture 40 in the base 24 to allow the lower contact arm 34 to be secured to the base 24 with the fastener 38. The lower leg portion 58 extends outwardly toward the line side portion 42 of the housing 22 and forms a line side conductor portion 60. A free end 64 of the line side conductor portion 60 defines an electrical terminal to allow the line side of the circuit breaker 20 to be connected to an external electrical circuit (not shown).

The upper main contact 32 is carried by an upper contact arm 66 mechanically coupled to an operating mechanism 68 and an operating handle 70. The operating mechanism 68 does not form a part of the present invention and is similar to the operating mechanism described in detail in commonly assigned U.S. Pat. Nos. 4,642,430 and 4,642,431, which are incorporated herein by reference. The operating mechanism 68 allows the circuit breaker 20 to be operated manually by way of the operating handle 70 or automatically in response to an overcurrent condition detected by an electronic trip unit 71.

In multiple pole circuit breakers, the upper contact arms 66 are mounted independent of each other. Thus, in the case of a relatively high level short circuit current on one pole, only that pole will be blown open by magnetic repulsion forces developed between the upper contact arm 66 and the lower contact arm 34 as illustrated in phantom in FIG. 1. The remaining poles remain closed. However, in order to prevent a condition known as single phasing, the electronic trip unit 71 detects the current imbalance in the untripped poles and actuates the operating mechanism 68 to cause the remaining poles to trip.

The upper contact arm 66 is electrically coupled to a load side conductor 72 by way of a flexible electrical conductor 74, such as a woven copper braid. The load side conductor 72 is securely fastened to the base 22. The free end 79 of the load side conductor 72 forms an electrical terminal to allow the load side of the circuit breaker 20 to be connected to an external electrical circuit (not shown).

The U-shaped portion 54 of the lower contact arm 34 generates the required magnetic repulsion forces between the lower contact arm 34 and the upper contact arm 66 to cause the main contacts 30 and 32 to blow apart during relatively high level overcurrent conditions. More specifically, during a relatively high level overcurrent condition, such as a short circuit current, the current flowing through the lower contact arm 34 and the upper contact arm 66 will be flowing in the direction of the arrows in FIG. 1. As illustrated, the current in the upper and lower contact arms 66 and 34 flows in opposite directions generating magnetic repulsion forces. Since the upper main contact arm 66 is pivotally mounted, 66 the magnetic repulsion forces cause the contact arm to blow open, thus separating the upper and lower main contacts 32 and 30, respectively.

Disposed adjacent the upper and lower main contacts 32 and 30 is an arc chute 78. Arc chutes 78 are well known in the art and are comprised of a series of generally horizontal plates 75 rigidly attached to a pair of upstanding side walls 80. The arc chutes 78 are used to disperse the energy in an arc generated when the main contacts 30 and 32 are separated. One arc chute 78 is provided for each pole. Thus, for a three pole breaker, three arc chutes 78 are required. In some known circuit breaker applications, due to the relatively high magnitude of an overcurrent, an arc chute 78 alone is insufficient to disperse all of the energy in the arc. In such an application, a pivotal lower contact arm, such as disclosed in U.S. Pat. Nos. 4,642,430 and 4,642,431, is used in addition to the arc chute 78. However, such an arrangement is relatively more complicated and expensive than a rigidly mounted lower contact arm. Accordingly, the present invention solves this problem by allowing a rigidly mounted lower contact arm 34 to be used in an application where only pivotally mounted lower contact arms have heretofore been known to be used because of the relatively large magnitude of the overcurrent. Specifically, an arc runner assembly 82 is disposed adjacent the lower main contact 30. The arc runner assembly 82 directs the arc resulting from the separation of the main contacts 30 and 32 into the arc chute 78, thus allowing relatively higher level overcurrents to be interrupted without the use of a pivotally mounted lower contact arm.

One arc runner assembly 82 is provided for each pole. The arc runner assembly 82 is inserted into the bight portion 59 of the U-shaped portion 54 of the lower contact arm 34. Each arc runner assembly 82 includes a support block 84 runner 86. The support blocks 84 may be molded from an electrical insulator material, such as glass polyester. The height of the arc runner assembly 82 is such to allow a snug fit between the depending upper and lower leg portions 56 and 58 of the lower contact arm 34. The width of the support block 84 is formed substantially equivalent to the width of the lower depending leg portion 58 of the lower contact arm 34. The support blocks 84 have a generally rectangular block portion 88, integrally formed with two vertically extending spaced apart walls 90. The space between the vertical walls 90 defines a slot 92 for receiving the arc runners 86. An aperture 94, centered along a transverse axis 96 of the support block 84, is used for mechanically restraining the arc runner 86 to prevent it from moving in a longitudinal direction. Formed integral with the spaced apart walls 90 are extending tongue portions 98 which extend upwardly but are disposed substantially flush with a top portion of the arc runner 86 that engages the underside of the upper depending leg portion 56 of the lower contact arm 34. The support block 84 may be provided with chamfered edges 100 along the bottom surface 102 of the support blocks 84. Additional chamfered edgs 103 may be provided adjacent the top surface of the extending tongue portions 98 to facilitate installation. The bottom surface 102 of the support block 84 directly engages and acts as a bearing surface for the lower depending leg 58 of the lower main contact arm 34.

The arc runners 86 are adapted to be received in the slot 92 formed in the support block 84. A retaining boss portion 106 formed on the bottom portion of the arc runner 86 is received in the aperture 94 to prevent longitudinal movement of the arc runner 86 with respect to the support block 84.

The arc runner 86 is formed as a generally L-shaped metallic member having a vertically extending leg portion 108 and a horizontal leg portion 110. The horizontal leg portion formed as a stepped surface. The uppermost portion 112 of the stepped surface extends substantially flush with the extending tongue portions 98 to form a bearing surface for engaging the upper depending leg portion 56 of the lower contact arm 34. The vertical leg portion 108 is adapted to be disposed contiguous with the lower contact arm 34. By disposing the arc runner 86 in such a manner, the arc developed when the main contacts 30 and 32 are separated is transferred from the main contacts 30 and 32 to the arc runners 86, thus reducing wear on the main contacts 30 and 32. By disposing the arc runner 86 adjacent the lower main contact 30, the arc developed during a separation of the main contacts 30 and 32 is more readily directed into the arc chute 78 while allowing minimal wear or damage to the main contacts 30 and 32. The above arrangement allows a relatively higher level overcurrent to be interrupted without the need to provide a pivotally mounted lower contact arm assembly as disclosed in U.S. Pat. Nos. 4,642,430 and 4,642,431.

Figures 4, 5, 6, 7:
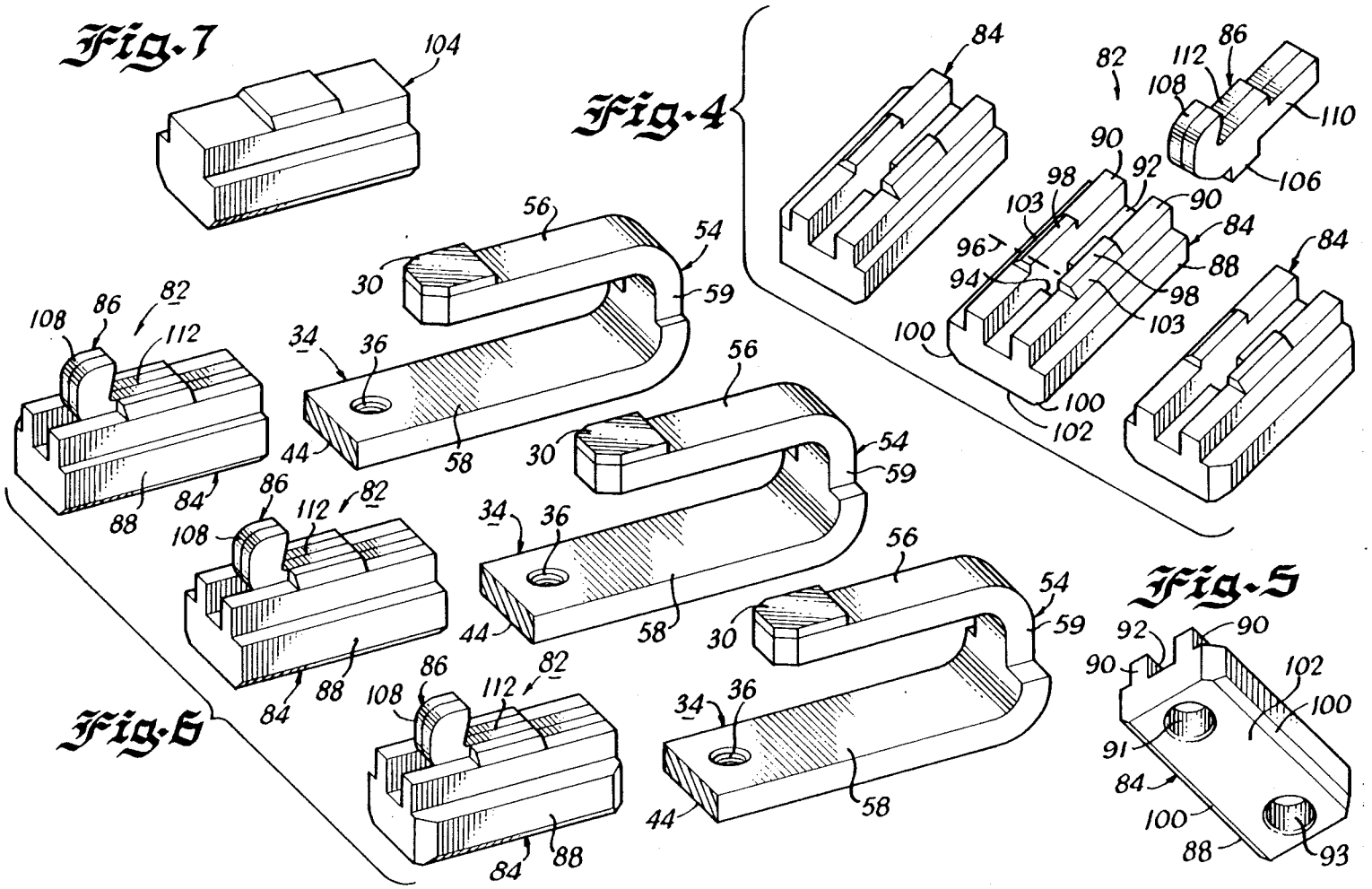
FIG. 4 is an exploded perspective view of the arc runner assemblies in accordance with the present invention.
FIG. 5 is a perspective view of the underside of a support block in accordance with the present invention.
FIG. 6 is an exploded perspective view of the support blocks prior to insertion into the lower contact arm.
FIG. 7 is a perspective view of an alternative support block in accordance with the present invention.

The arc runner assembly 82 also provides support for the lower contact arm 34 to prevent the upper and lower depending leg portions 56 and 58 from bending toward each other as a result of repeated operations of the circuit breaker 20. More specifically, due to the forces generated by the operating mechanism 68 during a closing operation, repeated closures of the main contacts 30 and 32 may cause the upper depending leg portion 56 of the lower contact arm 34 to bend downwardly. Downward bending or deflection of the upper leg portion 56 may affect the normal contact pressure between the main contacts 30 and 32 and may eventually cause arcing while the contacts 30 and 32 are closed, particularly if a relatively small copper bar is used for the lower contact arm. Accordingly, in an alternative embodiment of the invention, illustrated in FIG. 7, a modified support block 104 is shown. The modified support block 104 may be used in applications where either an arc runner 86 is not required or where the arc runner 86 is carried by the lower contact arm 34.

The arc runners 86 may be formed from a electrically conductive material, such as steel and may be formed either from a single piece or may be comprised of several pieces and laminated as shown in FIGS. 2, 3, 4 and 6. It has been found to be relatively easier to stamp relatively thin material and form the arc runner 86 as a laminated assembly. Such a design also reduces the eddy currents. However, it should be understood by those of ordinary skill in the art that the principles of the invention are applicable to single piece arc runners 86 as well.

In order to secure the support block 84 to the lower contact arm 34, the support block 84 is provided with an aperture 91 on the undersurface which captures an extending portion 103 of the fastener 38. This arrangement prevents movement of the support block 84 with respect to the lower contact arm 34. In some applications, in order to reduce the overall width of the circuit breaker, the outside pole arc runner assemblies may be offset with respect to the outside pole center lines, for example, inwardly. In such aplications, in order to reduce the types of molded parts required, a support block 84 may be provided with an offset, which can be used in either outside pole by simply rotating the support block 84 by 180°. In this application, a second aperture 92 is provided on the underside of the support block 84 such that the support block 84 can be used with either outside pole.

Obviously, many modifications and variations of the present invention are possible in light of the above teachings. Thus, it is to be understood that, within the scope of the appended claims, the invention may be practiced otherwise than as specifically described above.

What is claimed and desired to be secured by a letters patent is:

1. A molded case circuit breaker, comprising:

a housing having a base portion and a cover portion;

an upper main contact;

an upper contact arm for carrying said upper main contact, pivotally mounted with respect to said base;

an operating mechanism, operatively coupled to said upper contact arm for actuating said upper contact arm;

a lower contact arm for carrying said lower main contact defining upper and lower depending leg portions and a bight portion, the lower depending leg portion rigidly secured to said base and the upper depending leg portion, carrying said lower main contact;

an arc runner;

a block of electrically insulating material defining an opening for receiving said arc runner, said block being disposed adjacent said bight portion of said lower contact arm for preventing movement of said depending leg portions with respect to each other, said combination of said block and said arc runner supporting said upper leg portion.

2. A molded case circuit breaker as recited in claim 1, wherein said block has a width substantially equivalent to the width of the lower contact arm.

3. A molded case circuit breaker as recited in claim 1, further including means to prevent axial movement of said arc runner with respect to said block.

4. A molded case circuit breaker as recited in claim 1, wherein said block has two vertical, spaced apart wall portions disposed on a top surface thereof defining a slot for receiving said arc runner.

5. A molded case circuit breaker as recited in claim 4, wherein said generally rectangular block is received adjacent said bight portion of said lower contact arm to act as a bearing surface for said upper leg portion of said lower contact arm.

6. A molded case circuit breaker as recited in claim 4, wherein said arc runners are formed as L-shaped members defining a horizontal leg portion and a vertical leg portion.

7. A molded case circuit breaker as recited in claim 6, wherein said horizontal leg portion of said arc runner is received in said slot and said vertical portion is disposed adjacent said lower contact arm.

8. A molded case circuit breaker as recited in claim 6, further including preventing means to prevent axial movement of said arc runner in said slot.

9. A molded case circuit breaker as recited in claim 8, wherein said preventing means includes a retaining boss formed on a bottom surface of said horizontal leg portion of said arc runner which engages the top surface of said generally rectangular block received in an aperture along a transverse axis of the generally rectangular block.

* * * * *